US012286850B2

(12) United States Patent
Zhao et al.

(10) Patent No.: US 12,286,850 B2
(45) Date of Patent: Apr. 29, 2025

(54) FULL-HOLE REVERSE CIRCULATION CLUSTER-TYPE DOWN-THE-HOLE (DTH) HAMMER WITH MULTIPLE INDEPENDENT CHANNELS

(71) Applicant: Haozhou Drilling Engineering Machinery (Shandong) Co., Ltd., Jinan (CN)

(72) Inventors: Yechen Zhao, Jinan (CN); Chengliang Yan, Jinan (CN); Fengzheng Jing, Jinan (CN); Yeshui Zhao, Jinan (CN); Yechun Zhao, Jinan (CN); Da Zhang, Jinan (CN)

(73) Assignee: HAOZHOU DRILLING ENGINEERING MACHINERY (SHANDONG) CO., LTD., Jinan (CN)

( * ) Notice: Subject to any disclaimer, the term of this patent is extended or adjusted under 35 U.S.C. 154(b) by 20 days.

(21) Appl. No.: 18/512,032

(22) Filed: Nov. 17, 2023

(65) Prior Publication Data

US 2024/0167341 A1 May 23, 2024

(30) Foreign Application Priority Data

Nov. 18, 2022 (CN) ..... 202211459044.1

(51) Int. Cl.
*E21B 21/12* (2006.01)
*E21B 4/16* (2006.01)
(Continued)

(52) U.S. Cl.
CPC ..... *E21B 21/12* (2013.01); *E21B 4/16* (2013.01); *E21B 10/38* (2013.01); *E21B 21/16* (2013.01)

(58) Field of Classification Search
CPC ... E21B 4/14; E21B 4/16; E21B 10/38; E21B 21/12; E21B 21/16
See application file for complete search history.

(56) References Cited

U.S. PATENT DOCUMENTS 884,152 A * 4/1908 Hardsocg ..... E21B 4/04 175/102
899,729 A * 9/1908 Hardsocg ..... E21B 4/16 175/96
(Continued)

FOREIGN PATENT DOCUMENTS

CN 102220837 A 10/2011
CN 203531744 U 4/2014
(Continued)

*Primary Examiner* — Jennifer H Gay
(74) *Attorney, Agent, or Firm* — Bayramoglu Law Offices LLC

(57) ABSTRACT

A full-hole reverse circulation cluster-type down-the-hole (DTH) hammer with multiple independent channels is provided. The DTH hammer includes a drill rod, a drill rod joint, a drill rod air pipe, a diversion chamber, at least one hammer, and an upper pressure plate, a lower pressure plate, and an upper outer hammer protection pipe for fixing the hammer, where at least one jet air pipe communicated with the diversion chamber and at least one drill cuttings discharge pipe are arranged between the hammers; lower ends of the jet air pipe and the drill cuttings discharge pipe are located close to a hammer drill bit; and the lower end of the jet air pipe is provided with jet holes for producing a negative pressure.

5 Claims, 4 Drawing Sheets

(51) Int. Cl.
*E21B 10/38* (2006.01)
*E21B 21/16* (2006.01)

(56) References Cited

U.S. PATENT DOCUMENTS

| | | | | | |
|---|---|---|---|---|---|
| 3,770,067 | A * | 11/1973 | Ikeda | ..... | E21B 21/00 175/96 |
| 3,773,121 | A * | 11/1973 | Ikeda | ..... | E21B 21/00 175/103 |
| 4,790,391 | A * | 12/1988 | Hamamura | ..... | E21B 4/14 173/198 |
| 2024/0167341 | A1 * | 5/2024 | Zhao | ..... | E21B 4/16 |

FOREIGN PATENT DOCUMENTS

| | | | | | |
|---|---|---|---|---|---|
| CN | 203531745 | U | | 4/2014 | |
| CN | 203531746 | U | | 4/2014 | |
| CN | 104499935 | A | | 4/2015 | |
| CN | 105781419 | A | | 7/2016 | |
| CN | 107687320 | A | | 2/2018 | |
| CN | 108104713 | A | * | 6/2018 | ..... E21B 21/16 |
| CN | 209704513 | U | | 11/2019 | |
| CN | 110644928 | A | | 1/2020 | |
| CN | 110984844 | A | | 4/2020 | |
| CN | 213775271 | U | | 7/2021 | |
| CN | 214463865 | U | | 10/2021 | |
| CN | 217462008 | U | | 9/2022 | |
| KR | 19990064758 | A | | 8/1999 | |
| WO | 2012041084 | A1 | | 4/2012 | |
| WO | WO-2017029680 | A1 | * | 2/2017 | ..... E21B 21/16 |
| WO | WO-2022114572 | A1 | * | 6/2022 | |

* cited by examiner

FULL-HOLE REVERSE CIRCULATION CLUSTER-TYPE DOWN-THE-HOLE (DTH) HAMMER WITH MULTIPLE INDEPENDENT CHANNELS

CROSS REFERENCE TO THE RELATED APPLICATIONS

This application is based upon and claims priority to Chinese Patent Application No. 202211459044.1, filed on Nov. 18, 2022, the entire contents of which are incorporated herein by reference.

TECHNICAL FIELD

The present disclosure relates to a reverse circulation cluster-type down-the-hole (DTH) hammer for drilling in a rock formation, and in particular to a full-hole reverse circulation cluster-type DTH hammer with multiple independent channels.

BACKGROUND

According to the circulation manner of the drilling fluid (gas), the existing drilling techniques are divided into two categories, reverse-circulation drilling and direct-circulation drilling. In all the reverse-circulation drilling techniques, the drilling fluid goes up through the central pipe of the drill rod. In all the direct-circulation drilling techniques, the drilling fluid goes up through the space between the drill rod and the wall of the wellbore. Among the existing DTH hammers, most use a direct-circulation drill cuttings discharge method, while a few use a reverse-circulation drill cuttings discharge method.

In the reverse-circulation drill cuttings discharge method, a local negative-pressure zone is formed at the bottom of the DTH hammer, and the drill cuttings directly enter the vertical central pipe through a drill cuttings discharge hole. After the drill cuttings go up to the top of the drill rod, they are discharged through a horizontal hose. Compared with the direct-circulation drill cuttings discharge method, the reverse-circulation drill cuttings discharge method can discharge drill cuttings quickly, clean the bottom of the borehole, reduce repeated crush operations of the drill cuttings, thereby achieving high drilling efficiency. Therefore, the reverse-circulation drill cuttings discharge method is becoming increasingly popular.

However, conventional reverse-circulation drill cuttings discharge methods mainly have the following shortcomings. First, the reverse-circulation drill cuttings discharge method requires a certain amount of liquid in the borehole to form an air-liquid mixture after air enters the drill cuttings discharge pipe. The air-liquid mixture can flow upwards due to its small specific gravity. As the air-liquid mixture flows upwards inside the drill cuttings discharge pipe, the liquid with a large specific gravity outside the drill cuttings discharge pipe is forced into the drill cuttings discharge pipe to form a reverse circulation. The theoretical condition for forming a reverse circulation is that the ratio of the depth of the drill cuttings discharge pipe buried in the liquid to the overall height of the drill cuttings discharge pipe, referred to as a sinking ratio, reaches 0.4 or above. If the sinking ratio is less than 0.4, the pressure of the liquid outside the drill cuttings discharge pipe is less than the upward flow resistance of the air-liquid mixture inside the drill cuttings discharge pipe, so no reverse circulation can be formed. Second, in conventional reverse-circulation drill cuttings discharge methods, the drill cuttings at the drill bit need to be collected into the central pipe of the drill rod, resulting in severe wear, high cost, and complex maintenance of the drill rod. Third, the existing DTH hammers use a straight drill cuttings discharge hole for reverse-circulation drill cuttings discharge. Generally, to ensure smooth drill cuttings discharge, it needs to crush the drill cuttings into small particles, which reduces the drilling efficiency. Even so, sometimes large-size drill cuttings still may not be discharged smoothly, causing the DTH hammer fail to work properly.

SUMMARY

The present disclosure provides a full-hole reverse circulation cluster-type DTH hammer with multiple independent channels. The present disclosure solves the following technical problems. Firstly, the present disclosure breaks the limit that the sinking ratio must be 0.4 or above, and can quickly discharge drill cuttings produced by the hammer from the bottom of the borehole in a timely manner. Secondly, the present disclosure avoids severe wear of drill cuttings to the central pipe. Thirdly, the present disclosure avoids repeated crush operations of drill cuttings, thereby improving drilling efficiency.

The present disclosure is achieved by the following solution.

The present disclosure provides a full-hole reverse circulation cluster-type DTH hammer with multiple independent channels, including a drill rod, a drill rod joint, a drill rod air pipe, a diversion chamber, at least one hammer, and an upper pressure plate, a lower pressure plate, and an upper outer hammer protection pipe for fixing the hammer, where at least one jet air pipe communicated with the diversion chamber and at least one drill cuttings discharge pipe are arranged between the hammers; lower ends of the jet air pipe and the drill cuttings discharge pipe are located close to a hammer drill bit; the lower end of the jet air pipe is provided with jet holes for producing a negative pressure; and an airflow direction of the jet holes is at an inclination angle with axial and radial directions of a drill cuttings discharge hole, such that after air is jetted out, a swirling negative pressure is formed to suck drill cuttings into the drill cuttings discharge pipe.

In the present disclosure, in order to improve the drill cuttings discharge effect, a preferred solution of the full-hole reverse circulation cluster-type DTH hammer with multiple independent channels is as follows: the jet air pipe and the drill cuttings discharge pipe are in a one-to-one correspondence and evenly distributed between the hammers; and the airflow direction of the jet holes is at a 5-30° inclination angle with the axial and radial directions of the drill cuttings discharge hole.

In the present disclosure, in order to further improve the jet effect of the full-hole reverse circulation cluster-type DTH hammer with multiple independent channels, 2 to 8 jet holes are arranged at a bottom of each jet air pipe.

In the present disclosure, in order to improve the drill cuttings discharge effect and prevent damage to the drill cuttings discharge pipe, a preferred solution of the full-hole reverse circulation cluster-type DTH hammer with multiple independent channels is as follows: an inner protection pipe is provided at a periphery of an upper end of the drill rod; the inner protection pipe is nested inside an outer protection pipe; a bearing is provided between the outer protection pipe and the inner protection pipe to make the outer protection pipe and the inner protection pipe mutually rotatable; a circular drill cuttings discharge chamber is formed between the inner protection pipe and the outer protection pipe; a lower end of the drill cuttings discharge chamber is communicated with the drill cuttings discharge pipe; a side of the drill cuttings discharge chamber is connected with a drill cuttings output pipe; the drill cuttings discharge chamber is provided therein with an arc-shaped drill cuttings discharge baffle above the drill cuttings discharge pipe; and the drill cuttings discharge baffle is a detachable structure.

In the present disclosure, in order to improve the drill cuttings discharge effect and prevent excessive crush of drill cuttings, a preferred solution of the full-hole reverse circulation cluster-type DTH hammer with multiple independent channels is as follows: an outer flange is fixed to the drill cuttings discharge hole at a bottom of the drill cuttings discharge pipe; the outer flange is circular and includes a serrated lower end; a roller shaft is fixed in a diameter direction of the lower end of the outer flange; the roller shaft is provided with a rotatable roller; and the roller includes a serrated diametric surface and protrudes slightly from the outer flange.

In the present disclosure, a preferred solution of the full-hole reverse circulation cluster-type DTH hammer with multiple independent channels is as follows: the roller is fixed to the roller shaft through a small sleeve; and a baffle is provided between the roller shaft and the outer flange to fix the roller shaft.

In the present disclosure, in order to help large-size drill cuttings smoothly enter into the drill cuttings discharge pipe, a preferred solution of the full-hole reverse circulation cluster-type DTH hammer with multiple independent channels is as follows: the roller includes two serrated ends and a central circumferential groove.

In the cluster-type hammer of the present disclosure, an external high-pressure air enters a diverter through the drill rod air pipe, and most of the air enters into the hammers to drive the drill bits of the hammers to work. The hammers are clustered to complete large-diameter borehole percussion drilling. A small portion of the air from the diverter enters the jet air pipe and is then sprayed out through the jet holes to produce a negative pressure at the bottom of the drill cuttings discharge pipe, thereby carrying the drill cuttings at the bottom of the borehole upwards. In this way, a reverse circulation is formed to quickly discharge the drill cuttings out of the borehole in a timely manner.

In the present disclosure, multiple small-diameter hammers are clustered to complete large-diameter (the diameter can be increased according to needs, and is basically not affected by the manufacturing process) borehole percussion drilling. The jet holes are arranged at the bottom of the drill cuttings discharge pipes. After the air is jetted out, a negative pressure is formed at the drill cuttings discharge hole, thereby directly sucking the drill cuttings. The drill cuttings can be directly discharged vertically from the bottom of the hammer. The design is not limited by whether there is water in the formation or whether the sinking ratio of the drill rod meets a requirement. Specifically, the sinking ratio is a ratio of the depth of a drill rod mixer (located at a position where an air supply channel and a drill cuttings discharge channel are communicated) buried in the liquid to the overall length of the drill rod, and the sinking ratio needs to reach 0.4 or more to form a reverse circulation in conventional technologies. In this way, the drill cuttings generated by the hammer can quickly be discharged from the bottom of the borehole, reducing the repeated crush operations of the drill cuttings, improving drilling efficiency, and allowing recovery and treatment of the drill cuttings for an environmental protection purpose.

The direction of the jet holes and the axial and radial directions of the drill cuttings discharge hole form an inclination angle, and after air is jetted out, a swirling flow is formed, making it easy to suspend and lift the drill cuttings.

A closed gap is formed between a drill bit body and a wellbore wall. The air passes through the hammer drill bit to form a high-pressure zone, and the drill cuttings discharge hole is in a negative-pressure suction zone, making it easy for the drill cuttings to be sucked to the drill cuttings discharge hole.

The drill cuttings discharge pipe is provided independently. One or more drill cuttings discharge pipes can be provided according to the diameter of the cluster-type DTH hammer. Alternatively, the diameter of the drill cuttings discharge pipe can be increased to improve the drill cuttings discharge effect.

The drill cuttings discharge pipe is perpendicular to a bottom surface of the DTH hammer and directly inserted into a bottom surface of the drill bit, allowing the drill cuttings to directly be discharge vertically. Multiple drill cuttings discharge pipes can be provided to facilitate even drill cuttings discharge from the bottom surface of the borehole.

In the present disclosure, a central pipe of the drill rod is used for air supply, and the drill cuttings are discharged through the separately provided drill cuttings discharge pipe. Multiple drill cuttings discharge pipes can be distributed at multiple points at the bottom of the drill bit according to the size of the drill bit. The drill cuttings are transported through the vertical drill cuttings discharge pipe to the arc-shaped drill cuttings baffle at the upper end, so the arc-shaped drill cuttings baffle bears the impact of the drill cuttings. Then, the drill cuttings enter the horizontal drill cuttings output pipe. Since the drill cuttings baffle is a detachable structure, it can be repaired or replaced after wear, reducing maintenance costs.

In the present disclosure, a serrated rotatable roller is added at the drill cuttings discharge hole. When the DTH hammer is working, it slowly rotates in the circumferential direction. The roller contacts the bottom of the borehole and rotates due to the frictional resistance of the rock surface at the bottom of the borehole, thereby moving the drill cuttings accumulated at the drill cuttings discharge hole into the drill cuttings discharge pipe. The drill cuttings are discharged due to the negative pressure. There is no need to crush the drill cuttings into smaller particles, greatly improving drilling efficiency. Under the action of the roller, large-size drill cuttings can be discharged, completely solving the clogging problem of the drill cuttings discharge hole.

The present disclosure has the following beneficial effects. Firstly, the present disclosure adopts the independent jet air pipe and the independent drill cuttings discharge pipe, and adopts the specially structured jet holes. The present disclosure breaks the limit by whether there is water in the formation, such that the drill cuttings produced by the hammer can be quickly discharged from the bottom of the borehole in a timely manner. 2. The drill cuttings are transported through the vertical drill cuttings discharge pipe to the arc-shaped drill cuttings baffle at the upper end, so the arc-shaped drill cuttings baffle bears the impact of the drill cuttings. Then, the drill cuttings enter the horizontal drill cuttings output pipe. The design reduces maintenance costs. 3. The rotatable roller can discharge large-size drill cuttings, reducing repeated crush operations of drill cuttings, completely solving the clogging problem of the drill cuttings discharge hole, and improving drilling efficiency.

Figure 1:
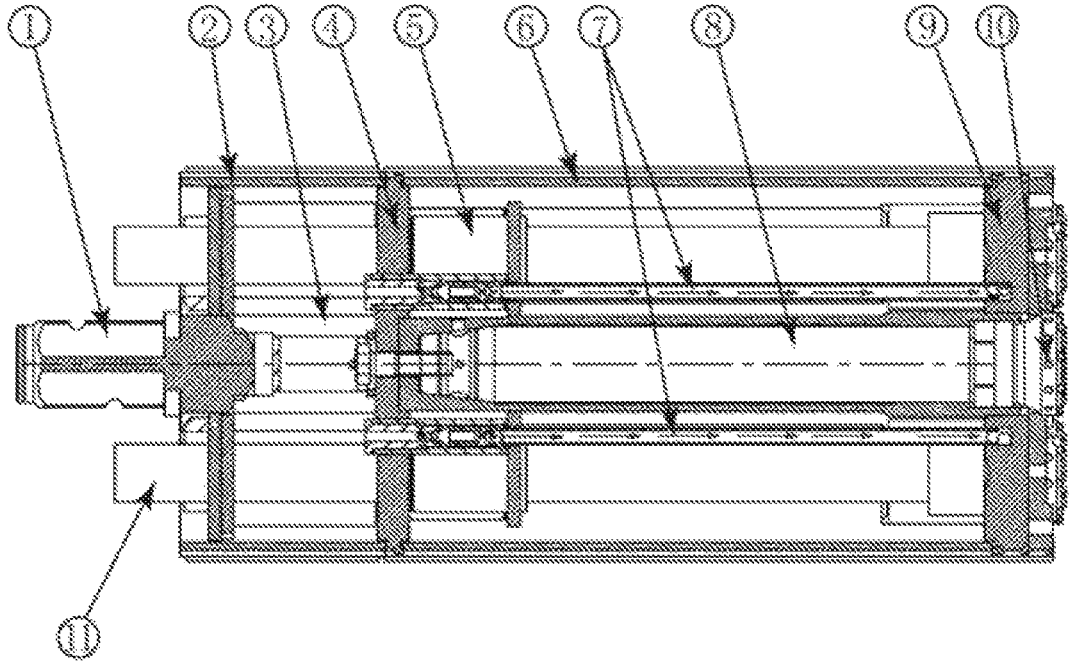
FIG. 1 is a front sectional view of a hammer part according to the present disclosure.
Figure 2:
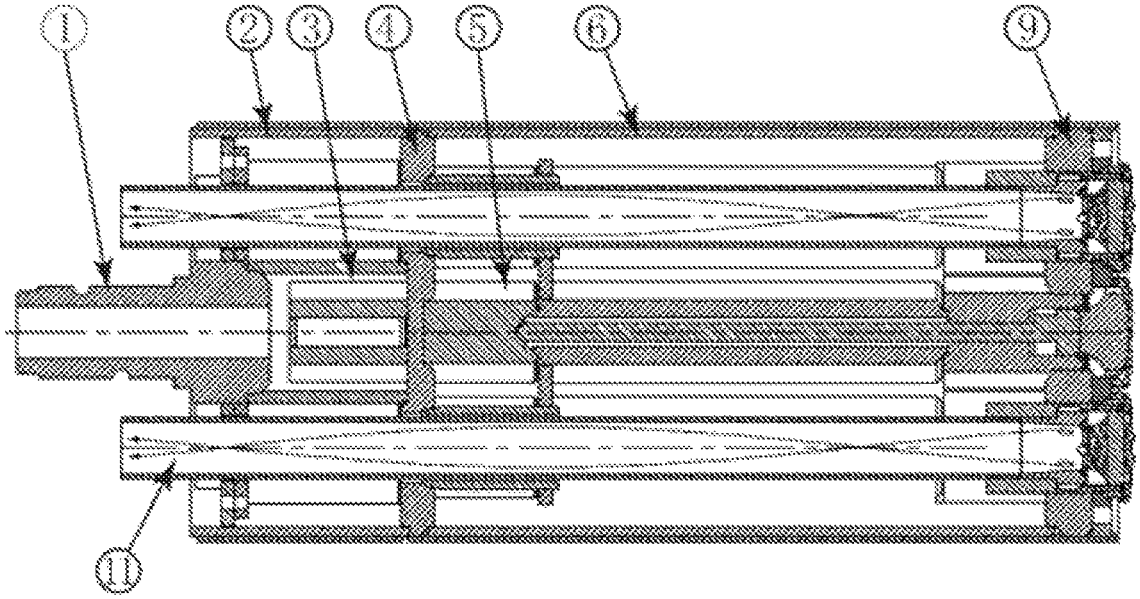
FIG. 2 is a top sectional view of the hammer part according to the present disclosure.

Reference Signs: 1. drill rod joint; 2. upper outer hammer protection pipe; 3. drill rod air pipe; 4. upper pressure plate; 5. diversion chamber; 6. lower outer hammer protection pipe; 7. jet air pipe; 8. hammer; 9. lower pressure plate; 10. hammer drill bit; 11. drill cuttings discharge pipe; 12. jet hole; 13. drill rod; 14. drill cuttings discharge chamber; 15. drill cuttings output pipe; 16. outer protection pipe; 17. bearing; 18. drill cuttings discharge baffle; 19. inner protection pipe; 20. outer flange; 21. roller shaft; 22. roller; 23. small sleeve; 24. baffle; and 25. DTH hammer.

DETAILED DESCRIPTION OF THE EMBODIMENTS

The present disclosure is described in detail below according to FIGS. 1 to 8.

As shown in FIGS. 1 to 8, the present disclosure provides a full-hole reverse circulation cluster-type DTH hammer with multiple independent channels. The DTH hammer includes drill rod (13), drill rod joint (1), drill rod air pipe (3), diversion chamber (5), at least one hammer (8), and upper pressure plate (4), lower pressure plate (9), and upper outer hammer protection pipe (6) for fixing the hammer (8). In the present disclosure, there are 9 hammers, including 6 hammers located at a periphery and 3 hammers located in a center. The drill rod air pipe (3) provides power to each hammer through the diversion chamber (5).

There are three independent drill cuttings discharge systems located between the hammers. Each of the drill cuttings discharge systems includes jet air pipes (7) connected with the diversion chamber (5), drill cuttings discharge pipes (11), and drill cuttings discharge chamber (14) located above the drill cuttings discharge pipes (11).

Figure 3:
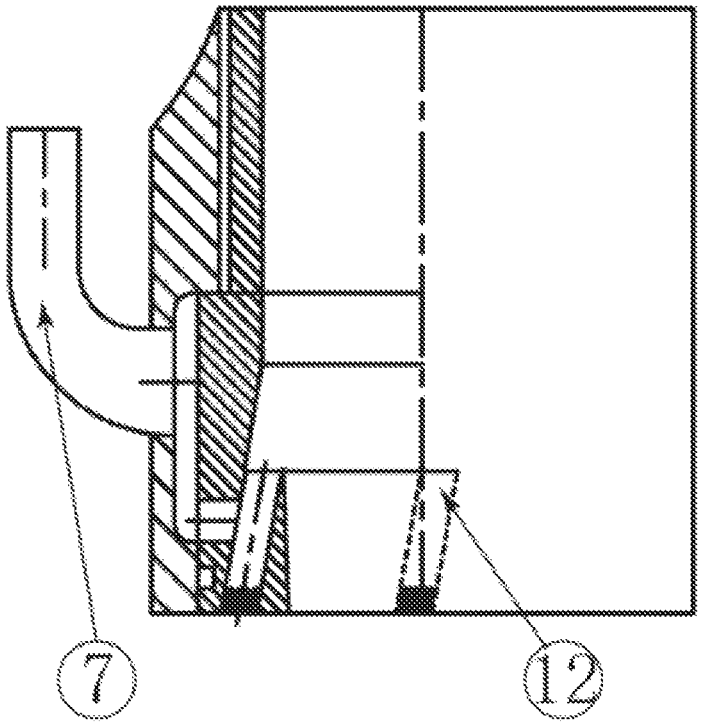
FIG. 3 is a front sectional view of a drill cuttings discharge hole part according to the present disclosure.
Figure 4:
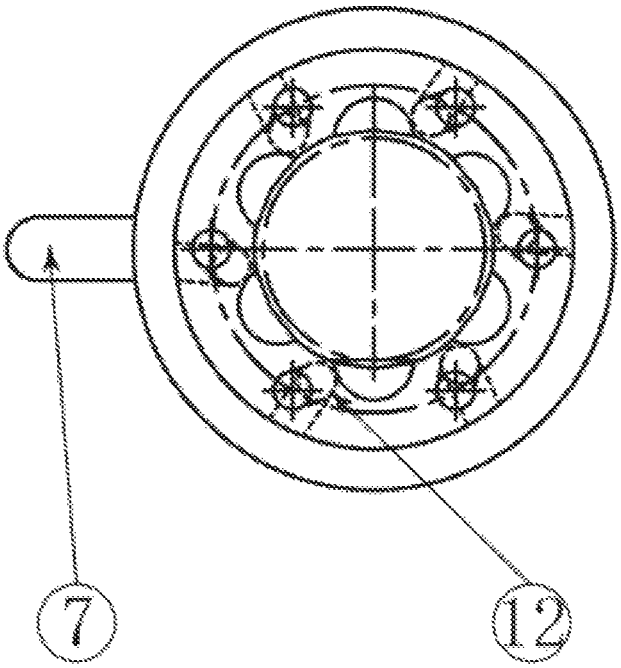
FIG. 4 is a bottom sectional view of the drill cuttings discharge hole part according to the present disclosure.
Figure 5:
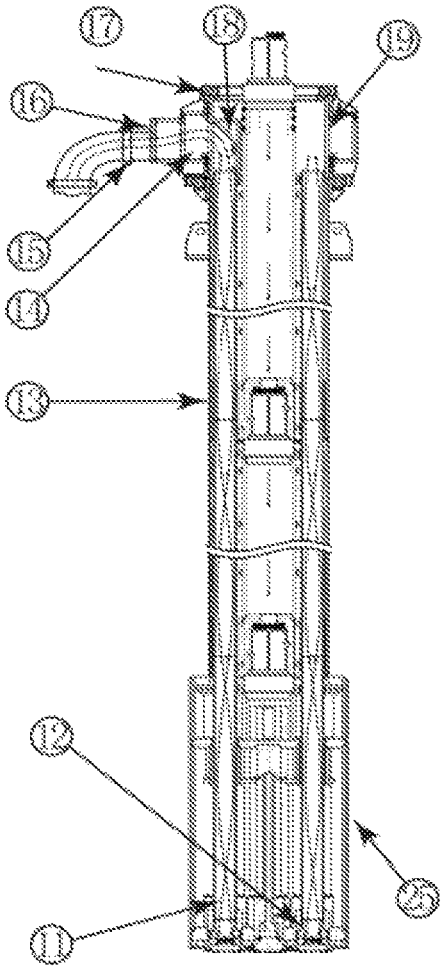
FIG. 5 is a front sectional view of a main body structure according to the present disclosure.

A lower structure of the drill cuttings discharge system is shown in FIGS. 3 to 5. Lower ends of the jet air pipes (7) and the drill cuttings discharge pipes (11) are located close to hammer drill bit (10). The lower end of each of the jet air pipes (7) is provided with jet holes (12) for producing a negative pressure. Specifically, a bottom of each of the jet air pipes (7) is provided with 6 jet holes (12). An airflow direction of the jet holes is at a 10° inclination angle with axial and radial directions of a drill cuttings discharge hole. Thus, after the air is jetted out, a swirling vacuum is formed, and the drill cuttings are discharged through the drill cuttings discharge pipe (11).

Figure 6:
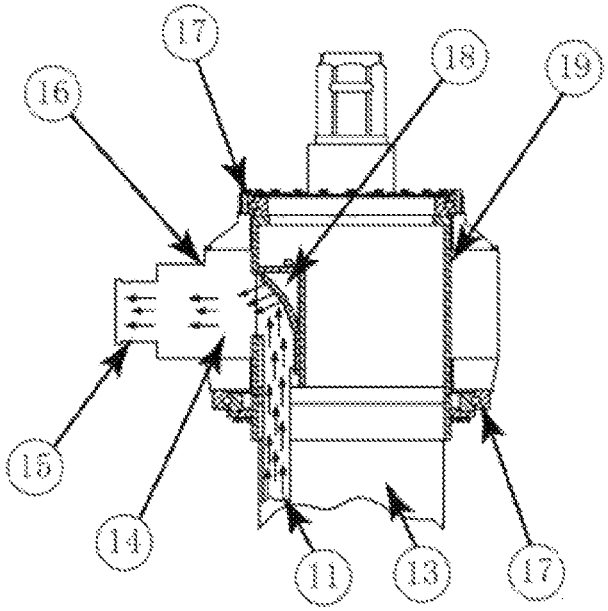
FIG. 6 is a structural diagram of a drill cuttings discharge chamber of a drill cuttings discharge mechanism according to the present disclosure.

An upper structure of the drill cuttings discharge system is shown in FIGS. 5 and 6. Inner protection pipe (19) is provided at a periphery of an upper end of the drill rod (13). The inner protection pipe (19) is nested inside outer protection pipe (16). bearing (17) is provided between the outer protection pipe and the inner protection pipe to make the outer protection pipe and the inner protection pipe mutually rotatable. Circular drill cuttings discharge chamber (14) is formed between the inner protection pipe and the outer protection pipe. A lower end of the drill cuttings discharge chamber (14) is communicated with the drill cuttings discharge pipes (11). A side of the drill cuttings discharge chamber (14) is connected with drill cuttings output pipe (15). The drill cuttings discharge chamber (14) is provided therein with arc-shaped drill cuttings discharge baffle (18) above the drill cuttings discharge pipes (11). The drill cuttings discharge baffle (18) is a detachable structure.

Figure 7:
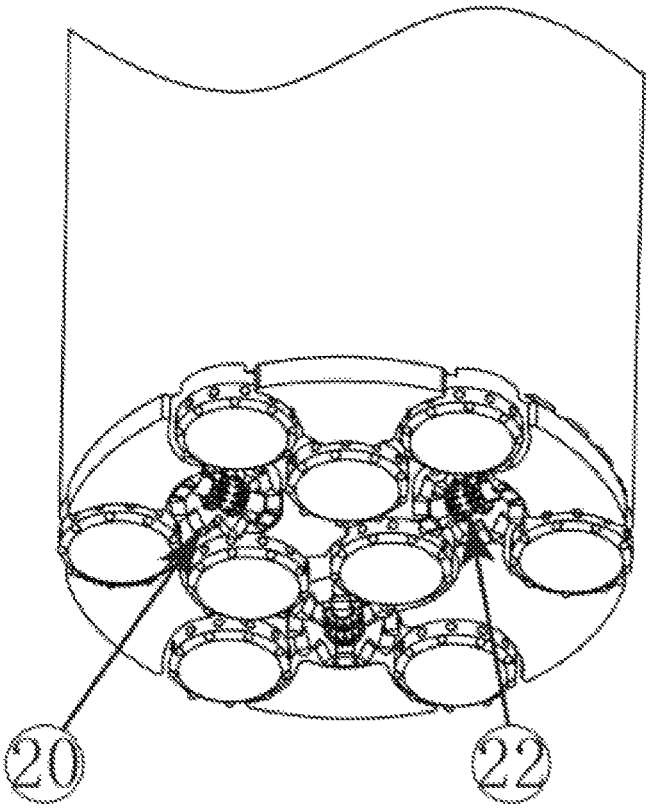
FIG. 7 is a structural diagram of a drill cuttings discharge hole of the drill cuttings discharge mechanism according to the present disclosure.
Figure 8:
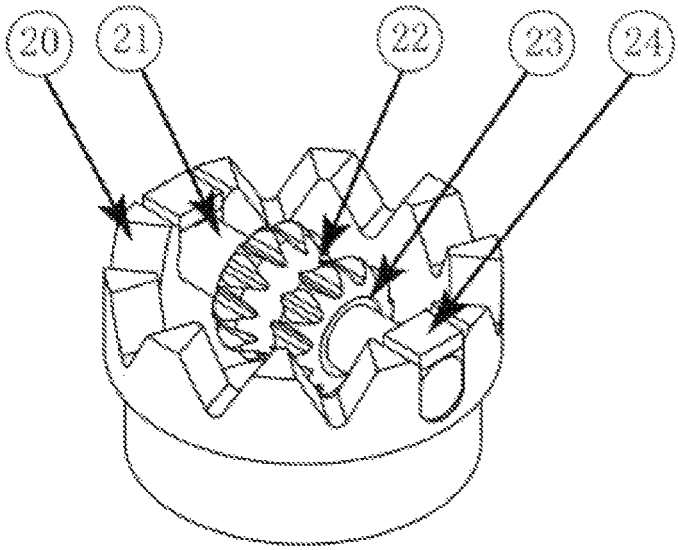
FIG. 8 is a structural diagram of an anti-clogging mechanism of the drill cuttings discharge mechanism according to the present disclosure.

A bottom structure of the drill cuttings discharge system is shown in FIGS. 7 and 8. Outer flange (20) is fixed to the drill cuttings discharge hole at a bottom of each of the drill cuttings discharge pipes (11). The outer flange is circular and includes a serrated lower end. Roller shaft (21) is fixed in a diameter direction of the lower end of the outer flange. The roller shaft (21) is provided with one rotatable roller (22). The roller protrudes slightly from the outer flange. The roller is fixed to the roller shaft through a small sleeve. A baffle is provided between the roller shaft and the outer flange to fix the roller shaft. The roller includes two serrated ends and a central circumferential groove. This structure can easily drive large drill cuttings, making them enter the drill cuttings discharge pipe smoothly.

What is claimed is:

1. A full-hole reverse circulation cluster-type down-the-hole (DTH) hammer with multiple independent channels, comprising a drill rod including a drill rod joint, a drill rod air pipe, a diversion chamber, at least one hammer, and an upper pressure plate, a lower pressure plate, and an upper outer hammer protection pipe, wherein at least one jet air pipe communicating with the diversion chamber and at least one drill cuttings discharge pipe are arranged adjacent to the at least one hammer; lower ends of the at least one jet air pipe and the at least one drill cuttings discharge pipe are located adjacent to a hammer drill bit to which the at least one hammer supplies force; the lower end of the at least one jet air pipe is provided with jet holes for producing a negative pressure; and an airflow direction of the jet holes is inclined with respect to a drill cuttings discharge hole, wherein after air is jetted out, a swirling negative pressure is formed to suck drill cuttings into the at least one drill cuttings discharge pipe;

an inner protection pipe is provided at a periphery of an upper end of the drill rod; the inner protection pipe is nested inside an outer protection pipe; a bearing is provided between the outer protection pipe and the inner protection pipe to make the outer protection pipe and the inner protection pipe mutually rotatable; an annular drill cuttings discharge chamber is formed between the inner protection pipe and the outer protection pipe; a lower end of the drill cuttings discharge chamber is in communication with the at least one drill cuttings discharge pipe; a side of the drill cuttings discharge chamber is connected with a drill cuttings output pipe; the drill cuttings discharge chamber is provided with an arc-shaped drill cuttings discharge baffle above the at least one drill cuttings discharge pipe; and the arc-shaped drill cuttings discharge baffle is a detachable structure;

the arc-shaped drill cuttings discharge baffle is located at an upper end of the inner protection pipe and takes on a bent arc;

an outer flange is fixed to the drill cuttings discharge hole at a bottom of the at least one drill cuttings discharge pipe; the outer flange is circular and comprises a serrated lower end; a roller shaft is fixed on the serrated lower end of the outer flange; the roller shaft is provided with a rotatable roller; and the rotatable roller comprises a serrated diametric surface and protrudes from the outer flange; and when the DTH hammer is working, the DTH hammer rotates in a circumferential direction; the serrated rotatable roller provided at the drill cuttings discharge hole contacts a bottom of a borehole and rotates due to a frictional resistance of a rock surface at the bottom of the borehole, the drill cuttings accumulated at the drill cuttings discharge hole move into the at least one drill cuttings discharge pipe; and the drill cuttings are discharged due to the swirling negative pressure.

2. The full-hole reverse circulation cluster-type DTH hammer with multiple independent channels according to claim 1, wherein the at least one jet air pipe is a plurality of jet air pipes, and the at least one drill cuttings discharge pipe is a plurality of drill cuttings discharge pipes, and the plurality of jet air pipes and the plurality of drill cuttings discharge pipes are in a one-to-one correspondence; and the airflow direction of the jet holes is at a 5-30° inclination angle with the axial and radial directions of the drill cuttings discharge hole.

3. The full-hole reverse circulation cluster-type DTH hammer with multiple independent channels according to claim 1, wherein 2 to 8 jet holes are arranged at a bottom of each jet air pipe.

4. The full-hole reverse circulation cluster-type DTH hammer with multiple independent channels according to claim 1, wherein the rotatable roller is fixed to the roller shaft through a sleeve; and a baffle is provided between the roller shaft and the outer flange to fix the roller shaft.

5. The full-hole reverse circulation cluster-type DTH hammer with multiple independent channels according to claim 1, wherein the rotatable roller comprises two serrated ends and a central circumferential groove.

* * * * *